US010612772B2

(12) United States Patent
Mravcak et al.

(10) Patent No.: US 10,612,772 B2
(45) Date of Patent: Apr. 7, 2020

(54) INCINERATING SYSTEM

(71) Applicant: Atlantis Research Labs Inc., Medicine Hat (CA)

(72) Inventors: Vladimir Mravcak, Regina (CA); Dale Neuman, Regina (CA)

(73) Assignee: Atlantis Research Labs Inc., Medicine Hat (CA)

( * ) Notice: Subject to any disclaimer, the term of this patent is extended or adjusted under 35 U.S.C. 154(b) by 11 days.

(21) Appl. No.: 16/086,878

(22) PCT Filed: Mar. 21, 2017

(86) PCT No.: PCT/CA2017/050359
§ 371 (c)(1),
(2) Date: Sep. 20, 2018

(87) PCT Pub. No.: WO2017/161450
PCT Pub. Date: Sep. 28, 2017

(65) Prior Publication Data

US 2019/0101280 A1 Apr. 4, 2019

Related U.S. Application Data

(60) Provisional application No. 62/311,251, filed on Mar. 21, 2016, provisional application No. 62/360,852,
(Continued)

(51) Int. Cl.
*F23C 5/08* (2006.01)
*F23D 14/02* (2006.01)
(Continued)

(52) U.S. Cl.
CPC ..... *F23C 5/08* (2013.01); *F23C 5/02* (2013.01); *F23C 7/00* (2013.01); *F23D 14/02* (2013.01);
(Continued)

(58) Field of Classification Search
CPC ..... F23G 7/08; F23C 5/08; F23C 7/00; F23D 14/02
(Continued)

(56) References Cited

U.S. PATENT DOCUMENTS 1,983,810 A * 12/1934 Rice ..... A41F 1/04 24/713.9
3,093,962 A 6/1963 Gluhareff
(Continued)

FOREIGN PATENT DOCUMENTS

EP 0552750 A2 7/1993
EP 0552750 B1 4/1996
(Continued)

OTHER PUBLICATIONS

Chinese Application No. 201780024314.7; dated Jun. 5, 2019; 4 pages.
(Continued)

*Primary Examiner* — Gregory L Huson
*Assistant Examiner* — Nikhil P Mashruwala
(74) *Attorney, Agent, or Firm* — Hall Estill Law Firm

(57) ABSTRACT

The present invention provides a fuel incinerating system comprising a fuel injector, a multi-stage fuel-air mixing device comprising a plurality of fuel intake tubes stacked vertically and configured to provide annular gaps between one or more of the vertically stacked fuel intake tubes to entrain ambient air to form a fuel-air mixture; and a combustor in communication with the fuel-air mixing device and defining a combustion chamber and in communication with an ignition source. The combustor is configured to impede flow of the fuel-air mixture through the combustion chamber to achieve a desired retention time of the fuel-air mixture within the combustion chamber to achieve substantially complete combustions of the fuel.

21 Claims, 18 Drawing Sheets

Related U.S. Application Data filed on Jul. 11, 2016, provisional application No. 62/441,010, filed on Dec. 30, 2016.

(51) Int. Cl.

| | |
|---|---|
| ***F23G 7/08*** | (2006.01) |
| ***F23C 7/00*** | (2006.01) |
| ***F23C 5/02*** | (2006.01) |
| ***F23D 14/08*** | (2006.01) |
| *F23J 15/00* | (2006.01) |

(52) U.S. Cl.
CPC ..... *F23D 14/08* (2013.01); *F23G 7/08* (2013.01); *F23C 7/008* (2013.01); *F23C 2900/06041* (2013.01); *F23J 15/003* (2013.01)

(58) Field of Classification Search
USPC ..... 431/8
See application file for complete search history.

(56) References Cited

U.S. PATENT DOCUMENTS

| | | | | |
|---|---|---|---|---|
| 3,807,940 | A | 4/1974 | Juricek | |
| 3,885,919 | A * | 5/1975 | Pillard | F23G 7/065 422/111 |
| 4,629,413 | A * | 12/1986 | Michelson | F23C 7/02 431/10 |
| 5,108,718 | A * | 4/1992 | Dummersdorf | B01J 19/088 110/238 |
| 6,012,917 | A * | 1/2000 | Wiseman | F23C 5/02 431/154 |
| 6,146,131 | A | 11/2000 | Wiseman | |
| 6,485,292 | B1 | 11/2002 | Rhodes et al. | |
| 7,896,645 | B2 | 3/2011 | Loving | |
| 8,083,494 | B2 * | 12/2011 | Laforest | F02C 3/32 417/151 |
| 8,096,803 | B2 | 1/2012 | Mashhour et al. | |
| 8,312,706 | B2 * | 11/2012 | Laforest | F02C 3/32 431/114 |
| 8,381,537 | B2 | 2/2013 | Morita et al. | |
| 8,967,995 | B1 | 3/2015 | Griffin et al. | |
| 9,464,804 | B2 | 10/2016 | Tremblay et al. | |
| 10,364,981 | B2 * | 7/2019 | Wang | F23C 6/04 |
| 2003/0059731 | A1 * | 3/2003 | Coffey | F23G 7/08 431/202 |
| 2003/0059732 | A1 * | 3/2003 | Coffey | F23G 7/08 431/352 |
| 2003/0106694 | A1 | 6/2003 | Wiseman | |
| 2013/0143170 | A1 | 6/2013 | Krebber et al. | |
| 2014/0147795 | A1 | 5/2014 | Tremblay et al. | |
| 2015/0050603 | A1 | 2/2015 | Griffin et al. | |

FOREIGN PATENT DOCUMENTS

| | | | |
|---|---|---|---|
| EP | 2636951 | A1 | 9/2013 |
| WO | 2017161450 | A1 | 9/2017 |

OTHER PUBLICATIONS

Office Action for Chinese Application No. 201780024314.7; dated Jun. 5, 2019; 5 pages.
Eurasian Application No. 201891976; 2 pages.
Office Action for Eurasian Application No. 201891976; dated Oct. 10, 2019; 2 pages.
Extended EP Search Report; dated Sep. 30, 2019; 7 pages.
PCT/CA2017/050359; International Search Report and Written Opinion; dated Jul. 20, 2017; 7 pages.
PCT/CA2017/050359; International Preliminary Report on Patentability; dated Jul. 23, 2018; 3 pages.

* cited by examiner

INCINERATING SYSTEM

CROSS-REFERENCE TO RELATED APPLICATIONS

The present application is a national stage application of a PCT application having International Application No. PCT/CA2017/050359, filed Mar. 21, 2017, which claims priority to U.S. Provisional Application having U.S. Ser. No. 62/311,251, filed Mar. 21, 2016, which claims the benefit under 35 U.S.C. 119(e), the disclosure of which is hereby expressly incorporated herein by reference.

FIELD

The invention relates generally to incinerator and flare systems for combustion of hydrocarbons, such as waste gases and liquids occurring at gas or oil drilling sites, or waste process gases and liquids from various chemical and petrochemical applications.

BACKGROUND

Flammable hydrocarbons are generally used as energy sources but some situations may require their destruction, for instance in the event of a production surplus or an unexpected shutdown of equipment. Some flammable hydrocarbons are byproducts of natural or industrial processes where the source cannot be stopped and/or be easily controlled, and cannot be stored for a later use.

One example of source of a flammable gas that cannot be stopped and/or be easily controlled is a landfill site. In a landfill site, organic matter contained in the waste slowly decays over time using a natural process, generating a gas stream containing methane ($CH_4$). Methane is a flammable gas and is mixed with other flammable and non-flammable gases in varying proportions when coming out of the landfill site. Methane gas is a valuable source of energy but is also a greenhouse gas if released directly into the atmosphere. Thus, if the methane gas contained in a gas stream coming out of a landfill site cannot be readily used or stored, it should be destroyed by combustion in a gas flare. Gas streams containing methane gas can also be created by other processes, for instance in an anaerobic digester. Many other situations and contexts exist.

Systems such as flare apparatus for burning and disposing of combustible gases and fluids are well known. Flare apparatus are commonly mounted on flare stacks and are located at production, refining, processing plants and the like for disposing of flammable waste gases or other flammable gas streams which are diverted for any reason, including, but not limited to venting, shut-downs, upsets and/or emergencies.

It is generally desirable that the flammable gas/liquid be burned without producing smoke and typically such smokeless or substantially smokeless burning is mandatory. One method for accomplishing smokeless burning is by supplying combustion air with a steam jet pump, which is sometimes referred to as an eductor. Combustion air insures the flammable gas is fully oxidized to prevent the production of smoke. Thus, steam is commonly used as a motive force to move air in a flare apparatus. When a sufficient amount of combustion air is supplied, and the supplied air mixes well with combustible gas, the steam/air mixture and flammable gas can be burned with minimal or no smoke.

In a typical flare apparatus, the required combustion air is supplied using motive force such as blower, a jet pump using steam, compressed air or other gas, along with obtaining air from the ambient atmosphere along the length of the flame.

U.S. Pat. No. 8,967,995, discloses a dual-pressure flare system which includes a dual-pressure flare stack having a central axis that is aligned with the center of a high-pressure outlet; a high-pressure flue having a central axis that is co-linear with the central axis of the dual-pressure flare stack; and a low-pressure flue connected to a low-pressure tip, and further includes an air-assist assembly having an air-supply connection connected to an air blower and a mixing chamber, wherein the mixing chamber surrounds the low-pressure tip.

U.S. Pat. No. 9,464,804 discloses gas flare system includes a vertical flare stack having an opened top end and a bottom floor wall, a burner arrangement provided through the bottom floor wall. The burner arrangement receives a waste gas stream from a waste gas circuit and also primary air. Secondary air orifices around the burner supply secondary air coming from a plenum housing located directly underneath the bottom floor wall.

EP 2636951 describes a combustion system comprising a combustion device, a heat exchanger and a stack. The combustion device is comprising a waste gas feed pipe, a support gas feed pipe, an air feed system, a mixing chamber for mixing air with waste gas and/or with support gas, and a gas permeable combustion surface onto which the waste gas will be burnt after the premix has flown through it, thereby producing flue gas. The stack connects the combustion device to the heat exchanger, thereby creating flue gas flow from the combustion device into the heat exchanger. The heat exchanger comprises channels for the flue gas and for at least one fluid to be heated.

U.S. Pat. No. 6,146,131 discloses a multiple burner assemblies fitted to the burner chamber consisting of upwardly directed nozzles for distributing the waste gas in the combustion chamber, as well as atomization of the waste gases and direct and discharge combustible waste gases upwardly into the burn chamber. In some embodiments, the lower end of the stack is formed of one or more axially displaced lower tubular shells which are concentrically spaced for forming annular inlets for admitting additional combustion air.

US2003/0059732 describes film cooling techniques and the maximum dilution of combustion products before they exit the system. This reference teaches use of segmented tubes placed above the combustion chamber to cool the products of the gas combustion. The system disclosed in this reference also includes one or more pairs of waste gas inlet ports and closure ports, wherein the inlet and closure port of each pair being located on opposing sides of the burn chamber.

The commonly used incinerator systems, such as disclosed in U.S. Pat. No. 6,146,131 and US2003/0059732 use flame-induced air flow, wherein the convection current generated by burners in the combustion chamber is used to draw more air towards combustor to achieve desired combustion.

Thus, there is a need for an improved apparatus, system and methods for smokeless burning of combustible gases and liquids with air to lessen the noise and to increase the efficiency whereby more fuel may be burned with less added motive forces such as steam, blower, etc.

SUMMARY OF THE INVENTION

The present invention relates to an incinerating system comprising an air-fuel mixing apparatus/device and a combustor system that provides a fuel-air mixture for incineration and/or fare gas operations.

In accordance with an aspect of the present invention, there is provided a fuel incinerating system comprising a fuel injector configured to inject fuel at a predetermined velocity; a multi-stage fuel-air mixing device having an inlet end and an outlet end, the multi-stage fuel-air mixing device being in fluidic communication at the inlet end with the fuel injector to receive fuel injected from the fuel injector to be mixed with entrained air to form a fuel-air mixture, the multi-stage fuel-air mixing device comprising a plurality of fuel intake tubes stacked vertically, each intake tube having an inlet and an outlet, wherein the cross sectional area of the inlet of each intake tube is greater than the cross sectional of the outlet of a preceding intake tube, thereby providing an annular gap between two adjacent intake tubes for entraining additional air when the fuel-air mixture is passed from one intake tube into the adjacent intake tube; a combustor extending vertically from the multi-stage fuel-air mixing device, the combustor having an inlet portion in fluidic communication with the outlet end of the multi-stage fuel-air mixing device, and an outlet portion to exhaust products of fuel combustion, said combustor defining a combustor chamber between the inlet and the outlet portions; said combustor further in communication with a primary ignition source; wherein the combustor is configured to impede flow of the fuel-air mixture through the combustion chamber to achieve a desired retention time of the fuel-air mixture within the combustion chamber.

Method of enhancing incineration of a fuel, the method comprising providing a vertically stacked multi-stage fuel-air mixing device having an inlet end and an outlet end, and being in fluidic communication with a fuel injector at one end and a combustor at the other end, the multi-stage fuel-air mixing device including a plurality of fuel intake tubes stacked vertically, each intake tube having an inlet and an outlet, wherein the cross sectional area of the inlet of each tube is greater than the cross sectional area of the outlet of a preceding intake tube thereby providing an annular gap between two adjacent tubes for entraining additional air; injecting a fuel into the multi-stage fuel-air mixing device to achieve velocity for the mixed air and fuel to flow into the combustor and entraining additional air when air-fuel mixture being passed into the adjacent fuel intake tube, impeding the flow of the mixed fuel and air through the combustor and achieving a desired retention time of the mixed fuel and air within the combustion chamber, thereby creating a fuel-air mixture having fuel to air ratio sufficient for substantially complete combustion of the fuel.

BRIEF DESCRIPTION OF THE FIGURES

Further features and advantages of the present improvements will become apparent from the following detailed description, taken in combination with the appended figures, in which.

DETAILED DESCRIPTION

Figure 1:
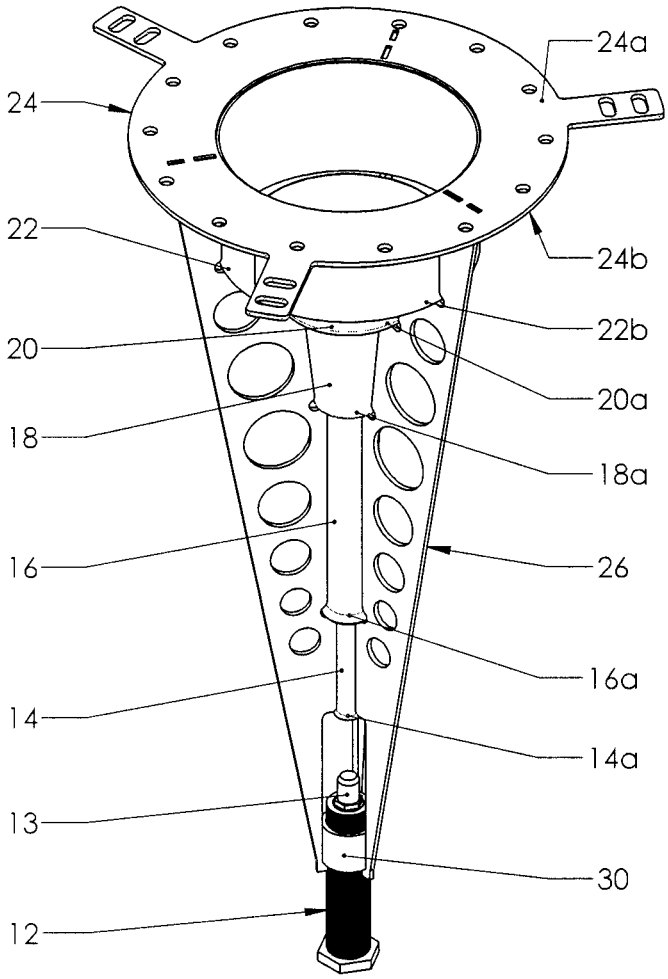
FIG. 1 is a perspective view of the fuel-air mixing system in accordance with an embodiment of the present invention.

Unless defined otherwise, all technical and scientific terms used herein have the same meaning as commonly understood by one of ordinary skill in the art to which this invention belongs.

The term "fuel" as used herein includes waste gases and liquids occurring at gas and oil drilling sites or waste process gases and liquids from chemical and petrochemical application. Non limiting examples of waste gases are gases comprising methane, propane, butane and pentane and mixture thereof.

The expression "substantially complete combustion" as used herein refers to the combustion wherein at least 80% of the fuel has been combusted.

The term "combustion region" as used herein refers to at least ¼ of the length of the combustor.

As used herein, the term "about" refers to approximately a +/−10% variation from a given value. It is to be understood that such a variation is always included in any given value provided herein, whether or not it is specifically referred to.

The present invention provides an incinerating system, which comprises a fuel injector coupled with a multistage air-fuel mixing device/apparatus and a combustor to provide a system that provides a fuel-air mixture ideal for substantially complete incineration and/or fare gas operations.

The incinerating system comprises in accordance with the present invention, comprises a fuel injector configured to inject fuel at a predetermined velocity/speed, a multi-stage fuel-air mixing device in fluidic communication with the fuel injector to receive fuel injected from the injector to be mixed with entrained air to form a fuel-air mixture. The multi-stage fuel-air mixing device comprises a plurality of fuel intake tubes stacked vertically, each intake tube having an inlet and an outlet, wherein the cross sectional area of the inlet of one or more intake tubes is greater than the cross sectional of the outlet of a preceding intake tube, thereby providing an annular gap between two adjacent intake tubes for entraining additional air when the fuel-air mixture is passed from one intake tube into the adjacent intake tube. A combustor disposed vertically upward from the multi-stage fuel-air mixing device. The combustor has an inlet portion in fluidic communication with the outlet end of the multi-stage fuel-air mixing device, and an outlet portion to exhaust products of fuel combustion. The combustor defines a combustor chamber between the inlet and the outlet portions, and also communicates with a primary ignition source.

The fuel intake tubes are configured so that the fuel injected by the fuel injector and the initial entrained air move upward the fuel intake system with a velocity/speed sufficient to reach the combustion chamber while entraining additional air when air-fuel mixture is ejected from the outlet of one fuel intake tube into the inlet of the adjacent fuel intake tube. The combustor is configured to impede flow of the fuel and air mixture through the combustion chamber to achieve a desired retention time of the mixed fuel and air within the combustion chamber.

The Applicant has surprisingly found that by injecting a fuel at a predetermined forced velocity/speed at the entrance of a fuel intake system as described herein, provides adequate fuel velocity for a fuel air mixture to flow upwardly and to entrain additional air on the way to form a fuel-air mixture having fuel to air ratio sufficient for a substantially complete combustion/incineration reaction without requiring use of motive forces. It has been established that by impeding the flow of the fuel air mixture (generated by the fuel intake system of the present invention) through the combustion chamber to achieve a desired retention time of the mixed fuel and air within the combustion chamber results in substantially complete destruction of the fuel.

It has been established that an enhanced level of combustion/incineration can be achieved by achieving an exit velocity for the products of fuel combustion in feet per second of less than two time the length of the combustion region and greater than speed of combustion of fuel.

Speed of combustion of a fuel is known in the art and/or can easily be calculated based on calculation methods known in the art. For example, speed of combustion of methane is known to be about 1 foot/second, and that of propane is 2.8 feet/second.

The present invention has also established that the required velocity/speed for the fuel-air mixture, for a particular fuel and the desired retention time/residency of the fuel-air mixture in the combustor chamber can be achieved by appropriate selection of nozzle for the fluid injector, size and positioning of annular gaps for air entrainment, size and positioning of air intake tubes and/or size and positioning of combustor.

The length to width/diameter ratio of fuel intake tubes closer to the fuel injector is generally higher than the length to width ratio of the fuel intake tubes closer to the combustor.

The selection of the number of the intake tubes and their relative lengths and widths depends upon the size and type of combustor and/or the type and/or volume of the fuel to be incinerated.

A fuel intake tubes can have a constant cross sectional area or a cross sectional area increasing from the inlet end to the outlet end.

In some embodiments the fuel intake tubes have lengths and widths configured to have a non-resonating alignment to achieve velocity/momentum sufficient for flow of the fuel-air mixture to reach the combustor chamber while creating a final fuel-air mixture having fuel to air ratio facilitating substantially complete destruction/incineration of the fuel.

In the context of the present invention, the fuel intake tubes having length to diameter (or width) ratio less than 1:1 (or having diameter to length ratio more than 1:1) are also referred to as "diffuser ducts". The fuel intake tubes having length to diameters/width ratio of 1:1 or more (or having diameter to length ratio less than 1:1) are also referred to as "concentrator ducts".

The incinerating system of the present invention can have one or more diffuser ducts and one or more concentrator ducts.

In some embodiments, the cross sectional area of the concentrator ducts is constant, while the cross sectional area of one or more diffuser ducts increases from the inlet end toward outlet end.

In some embodiments the cross sectional area of at least the first diffuser ducts increases from the inlet end toward outlet end, and the cross sectional of the last diffuser duct is constant.

In some embodiments, the multi-stage fuel-air mixing device of the present invention comprises a first fuel intake tube in the form of a concentrator duct, having a first tube inlet configured to receive fuel injected from the fuel injector and entrained air to produce a first fuel-air mixture, and a first tube outlet for ejecting the first fuel-air mixture; and a second fuel intake tube as a second concentrator duct, having a second tube inlet configured to receive the first tube outlet and the first fuel-air mixture ejected from the first tube outlet and an additional ambient air entrained to produce a second fuel-air mixture, and a second tube outlet for ejecting the second fuel-air mixture. The fuel-air mixer further comprises a diffuser duct having a diffuser duct inlet configured to receive the second tube outlet and the second fuel-air mixture ejected from the second tube and additional ambient air entrained to produce a third fuel-air mixture, and a diffuser duct outlet configured to be in communication with the inlet of the combustor chamber for discharging the third fuel-air mixture.

In some embodiments, the fuel-air mixing device can have one or more additional intake tubes as concentrator ducts and/or one or more additional diffuser ducts.

In an aspect of the above embodiments, the fuel-air mixing device comprises three diffuser ducts and two concentrator ducts, wherein the first diffuser duct is configured to receive the second tube outlet in its inlet, the second diffuser duct is configured to receive the first diffuser duct outlet in its inlet, and the third diffuser duct is configured to receive the second diffuser duct outlet in its inlet, and has an outlet configured to communicate with the inlet of the combustor.

In one aspect of the above embodiments, the first diffuser duct has a cross sectional area that increases from the inlet end towards the outlet end, and the second diffuser duct has a constant cross sectional area from inlet end to outlet end.

In another aspect of the above embodiments, the first diffuser duct has a cross sectional area gradually increasing toward its outlet, the second diffuser duct has a cross sectional area rapidly increasing towards its outlet, and the third diffuser duct has a constant cross sectional area.

In some embodiments, the fuel-air mixing system comprises four diffuser ducts and three concentrator ducts, wherein the first diffuser duct is configured to receive the outlet of the third concentrator tube in its inlet, the second diffuser duct is configured to receive the first diffuser duct outlet in its inlet and so on, and the fifth diffuser duct is configured to receive the second diffuser duct outlet in its inlet, and has an outlet configured to communicate with the inlet of the combustor.

In one aspect of the above embodiment, the first to third diffuser ducts have cross section areas increasing from the inlet towards outlet and the fourth diffuser duct has constant cross sectional area.

In some embodiments, one or more of the fuel intake tubes have diverging sections at the inlet and the outlet. In some embodiments, the one or more of the fuel intake tubes have an hour glass like configuration.

The required velocity/speed for the fuel-air mixture, for a particular fuel and the desired retention time/residency of the fuel-air mixture in the combustor chamber can be achieved by appropriate selection of nozzle for the fluid injector, size and positioning of annular gaps for air entrainment, size and positioning of air intake tubes and/or size and positioning of combustor.

In some embodiments, the ratio of the cross sectional area of the inlet and outlet of two adjacent fuel intake tubes is from about 1.1:1 to about 4:1. In some embodiments, the ratio of cross sectional area of the inlet and outlet of two adjacent fuel intake tubes is from about 1.1:1 to about 2:1.

In some embodiments, the combustor has a length to diameter ratio from about 2:1 to about 20:1, from about 3:1 to about 10:1, or from about 4:1 to about 6:1.

In some embodiments, the ratio of the length of the combustor to the combined length of the fuel-intake tubes is about 1:1 to about 10:1.

In some embodiments, the ratio of combined lengths of the diffuser ducts to the combined length of the concentrator ducts is about 1:1 to about 10:1. In some embodiments, the ratio of combined lengths of the diffuser ducts to the combined length of the concentrator ducts is about 1:1 to about 1:10. In some embodiments, the ratio of combined lengths of the diffuser ducts to the combined length of the concentrator ducts is about 1:1 to about 2:1. In some embodiments, the ratio of combined lengths of the concentrator ducts to the combined length of the diffuser ducts is about 2:1 to about 1:1.

In some embodiments, the relative positioning of the first concentrator duct into the second concentrator duct, and/or the positioning of the second concentrator duct into the first diffuser duct, and/or the position of the first diffuser duct into the second diffuser duct is adjustable to achieve the fuel to air ratio in the final fuel-air mixture specific for a particular fuel.

The fuel-air mixing system further comprises coupling members to hold the fuel-air mixing system in position. In some embodiments, the intake tubes and the diffuser ducts are held in the position by longitudinally oriented brackets having notches positioned and configured to engage the inlets of the intake tubes and the diffuser ducts.

In some embodiments, three of such brackets are used to couple the components of the fuel-air mixing system. In some embodiments, the brackets are attached to the injector at one end and to a flanged ring on the other end, wherein the flanged ring is configured to fit on the outlet end of the last diffuser duct.

In some embodiments, the brackets are made thin in order to minimize their resistance to inflowing air.

In some embodiments, the brackets are shaped as fins. In some embodiments, the fins are perforated to minimize their resistance to air.

In some embodiments, the fuel intake tubes can be connected via a plurality of coupling members, such that one coupling connects two adjacent components. For example one coupling will couple the first tube inlet in line with the nozzle of the fuel injector, a second coupling will connect the first tube outlet with the second tube inlet and so on.

In some embodiments, the flanged ring of the fuel-air mixing system is also configured to attach the fuel-air mixing system with the combustor, such that the outlet of the last diffuser duct is in communication with the inlet of the combustor chamber.

In some embodiments, the outlet end of the last fuel intake tube duct can be welded directed into the inlet end of the combustor.

In some embodiments, the combustor of the present invention has an elongated combustor chamber. In some embodiments, the combustor has a constant cross sectional area. In some embodiments, the combustion chamber has a cross sectional area increasing from its inlet portion to its outlet portion.

It will be understood that the overall size and shape of the combustors in the present invention can be varied to generate a combustor which is adapted to achieve desired retention time for a specific fuel.

In some embodiments, the combustor has a generally cylindrical body. Other shapes can also be used instead. For example, the combustor and/or combustion chamber can be made with a generally ellipsoidal cross-section.

In some embodiments, the outlet portion of the combustor is segmented and comprises two or more stacked cylindrical segments each having an inlet and an outlet, wherein inlet of each segment has a cross sectional area greater than the cross sectional area of the outlet of a previous segment, thereby providing further air intake locations between the two cylindrical segments In some embodiments, the combustor has a tail pipe extending from the combustion chamber and defining an outlet thereto.

In some embodiments, the exhaust pipe is configured as a segmented exhaust pipe, comprising two or more stacked cylindrical segments each having an inlet and an outlet.

In some embodiments, the inlet of the first cylindrical segment of the exhaust pipe which is connected to the combustor has a cross sectional smaller than the cross sectional area of the outlet end of the combustor, and the outlet end of at least one of the remaining cylindrical segments has a cross sectional area greater than the cross sectional area of the inlet of the previous cylindrical segment, thereby providing further air intake locations between the two cylindrical segments. In some embodiments, the outlets of each of the segments after the first segment has a cross sectional area greater than the cross sectional area of the inlet of the previous cylindrical segment, thereby providing further air intake locations between the two cylindrical segments.

In some embodiments, the first cylindrical segment is positioned above the combustor and its inlet has a cross sectional area that is greater than the cross sectional area of the outlet of the combustor, thereby providing a first air intake location between the combustor and the first cylindrical segment. In addition, the cross sectional area of the inlet of at least one of the remaining cylindrical segments has a cross sectional area greater than the outlet of the previous cylindrical segment, thereby providing further air intake locations between the two cylindrical segments. In some embodiments, the outlet of each of the remaining cylindrical segments has a cross sectional area greater than the cross sectional area of the inlet of the previous cylindrical segment, thereby providing further air intake locations between the two cylindrical segments.

Due to different cross sectional areas of the inlet(s) and outlet(s) of one or more of the cylindrical segments, support slots can be provided in a lower component, which provides for the support of a component above.

In some cases, the primary exhaust exiting the combustor chamber may include residual fuel that has not been combusted within the combustor. By providing segmented outlet portion in the combustor, the addition of air into the primary exhaust exiting the combustion chamber may enhance secondary combustion of this residual fuel within the first cylindrical segment, resulting in the generation of a secondary exhaust. The secondary exhaust may also include some residual fuel, and the addition of air into the secondary exhaust may enhance tertiary combustion within the second cylindrical segment. In this manner, due to the first and second air intakes, further combustion of residual fuel in the primary and secondary exhaust can provide a means for substantially full combustion of fuel that is input into the incinerator system.

In some cases, the primary exhaust exiting the combustor may include residual fuel that has not been combusted within the combustor. Within the first cylindrical segment the addition of air into the primary exhaust may enhance secondary combustion of this residual fuel within the first cylindrical segment, resulting in the generation of a secondary exhaust. The secondary exhaust may also include some residual fuel, and the addition of air into the secondary exhaust may enhance tertiary combustion within the second cylindrical segment. In this manner, due to the first and second air intakes, further combustion of residual fuel in the primary and secondary exhaust can provide a means for substantially full combustion of fuel that is input into the incinerator system.

As would be readily understood, further cylindrical segments may be integrated into the exhaust of the incinerator system. The length of the cylindrical segments may be configured to have sufficient length to provide a desired level of combustion, for example substantially complete combustion of the fuel by the incinerator system, while maintaining a desired level of throughput of fuel through the incinerator system.

In some embodiments, the outlet portion of the combustor further includes an annular ring on the interior.

In some embodiments, the outlet portion of the combustor tail pipe extending from the combustion chamber further include an annular ring on the interior thereof at the exit end. In some embodiments of the present invention, one or more of the cylindrical segments may further include an annular ring on the interior thereof at the exit end of the cylindrical segment.

In some embodiments, the outlet portion of the combustor and the tail pipe extending from the combustion chamber further include an annular ring on the interior thereof at the exit end. In some embodiments of the present invention, the outlet portion of the combustor and one or more of the cylindrical segments further include an annular ring on the interior thereof at the exit end of the cylindrical segment.

This annular ring can provide an impediment to the flow of fuel/air out of the particular cylindrical segment thereby increasing the retention time of the fuel/air within the particular cylindrical segment, which can further improve combustion efficiency of the system. The ring can have a semicircular shape, or a pyramidal shape, or other shape wherein the annular ring reduces the cross sectional area of the particular cylindrical segment, while still providing flow across the annular ring.

In some embodiments, the insertion of air at the first air intake or subsequent air intake of the exhaust pipe, may not be sufficient to initiate secondary combustion (or tertiary combustion). This instance may occur as pressure increases during the movement of the fuel/air along the length of the segmented exhaust pipe. In order to aid in the initiation of secondary combustion (or tertiary combustion), in some embodiments a secondary ignition source (or tertiary ignition source) can be provided within the segmented exhaust pipe. This secondary ignition source (or tertiary ignition source) can provide a means for further enhancing the efficiency of the incinerator system. According to embodiments, the secondary ignition source (or tertiary ignition source) is positioned proximate to the air intake or at a location that can be removed from the air intake location, while being within the path of the air entering the incinerator system at the air intake.

According to embodiments of the present invention, the combustor is configured to provide two or more segmented combustion chambers, wherein the first chamber communicating with the fuel-air mixing and intake system and a primary ignition source, is called the primary combustor and the subsequent chambers are called the afterburners. In such a system, the primary exhaust exiting the primary combustor is further combusted in the one or more afterburners thereby providing a means for substantially full combustion of fuel that is input into the incinerator system.

In order to aid in the initiation of secondary combustion (or tertiary combustion), in some embodiments a secondary ignition source (or tertiary ignition source) can be provided within the segmented combustion chambers. This secondary ignition source (or tertiary ignition source) can provide a means for further enhancing the efficiency of the incinerator system. According to embodiments, the secondary ignition source (or tertiary ignition source) is positioned proximate to the air intake or at a location that can be removed from the air intake location, while being within the path of the air entering the incinerator system at the air intake.

In some embodiments the shape, length and width of the combustor and tail pipe are configured to have a non-resonating alignment and/or configured not to generate thrust upon combustion of the fuel.

In some embodiments, the combustor has a floor section comprising the inlet and a roof section comprising the outlet.

In some embodiments, the floor section of the combustor is configured to attach to a flanged ring of the fuel-air mixing system.

In some embodiments, the combustor has a combusting canister extending from the roof section into the combustor chamber. In some embodiments, the combusting canister is coupled to the roof section of the combustor via a flanged ring. In some embodiments, the combustion canister has a plurality of the perforations or slots on its walls. In some embodiments, the canister is configured as a closed-bottom cylinder including a plurality of holes therein, on both the side walls and the bottom. In some embodiments the bottom is cone shaped. In some embodiment the bottom is a flat wall.

According to embodiments, the perforations of side walls increase in diameter upwardly towards the outlet portion of the combustor, and/or the holes in the bottom increase in diameter radially towards the outer edge of the bottom. This configuration of the perforation and hole size can provide a means for controlling flow within the incinerator as the injection of the fuel is located proximate to the centre location of the bottom of the canister. As such, velocity of the fuel air mixture in the central region of the combustor (and centre of the canister) will be higher than the velocity of the fuel air mixture at the edge of the canister, and by increasing the diameter of the holes towards the edge of the bottom of the canister may provide a means for "normalizing" flow within the canister. According to embodiments, similar normalizing of the flow of the within the canister may be enabled by the gradual increasing of the size of the holes in the canister from the bottom of the canister to the top of the canister.

The fuel injector of the present invention is contemplated to have varying nozzles. In some embodiments, the injector comprises a high pressure nozzle. In some embodiments, the nozzle is a supersonic, subsonic or hypersonic fluid nozzle. In some embodiments the fuel is injected at a pressure of about 0.5 psi to about 30 psi. The fuel injector can be coupled aerodynamically with the inlet of the first fuel intake tube.

According to some embodiments of the present invention, the incinerator system is enclosed by a protective shroud. According to some embodiments of the invention, the shroud is shaped as a cylinder optionally having openings/perforations/slots at the bottom and/or side walls therefore.

In some embodiments, the protective shroud can provide a level of protection from the heat generated by the incinerator system and/or enhance the cooling of the incinerator system. According to some embodiments, the protective shroud is formed with a hinged door or cover which can provide ease of access to the incinerator system enclosed therein.

In some embodiments the protective shroud enhances the cooling of the incinerator system. During the combustion process, the air void between the shroud and the incinerator system get heated, which moves vertically upwards resulting in the drawing of external air through the openings in the shroud. This movement of the air along the height of the incinerator system can aid in the transfer of heat from the incinerator system. In some embodiments of the present invention, the openings in the shroud can include inclined louvers which can be at level or have an upward directionality to the air during entry into the space between the incinerator system and the shroud.

According to some embodiments of the present invention, wherein the incinerator system includes segmented outlet portion or a segmented exhaust pipe, the portion of the protective shroud covering the segmented outlet portion or segmented portion of the exhaust pipe, is provided with a plurality of air entries. In some embodiments, these air entries are essentially aligned with one or more of the transition zones between the adjacent segments, wherein these air entries provide openings for external air to enter into the first air intake and/or the second air intake of the segmented exhaust pipe. In some embodiments, all of these air entries are aligned with the transition zones. By providing these opening within the shroud, cooler external air can be provided to the air intakes, which can improve the secondary and tertiary combustion of residual fuel in the segmented exhaust pipe.

In some embodiments, the air entries of the shroud are arranged to be off set with one or more of the transition zones between the adjacent segments. In some embodiments, all of these air entries are offset with the transition zones. The presence of offset air entries assist in enhancing cooling of the incinerator system.

The commonly used incinerator systems use flame-induced flow, wherein the convection current generated by burners in the combustion chamber is used to draw air towards combustor, which requires use of a very large incinerator volume and/or a mechanical system to reduce the size of the unit, and/or use of motive force such as blower, a jet pump using steam, compressed air or other gases for effective operations.

The present invention utilizes the kinetic energy of the injected fuel to create a fuel-induced venturi flow of the fuel through the fuel intake system described herein, while entraining air on the way to achieve a fuel-air mixture having air to fuel ratio for effective incineration of the fuel without requiring use of additional motive forces. In addition, the present invention has established that by impeding the flow of the fuel air mixture (generated by the fuel intake system of the present invention) through the combustion chamber to achieve a desired retention time of the mixed fuel and air within the combustion chamber results in substantially complete destruction of the fuel. The Applicant has found that with the present system more than 90% of combustion can be achieved.

Exemplary Embodiments

Figure 2:
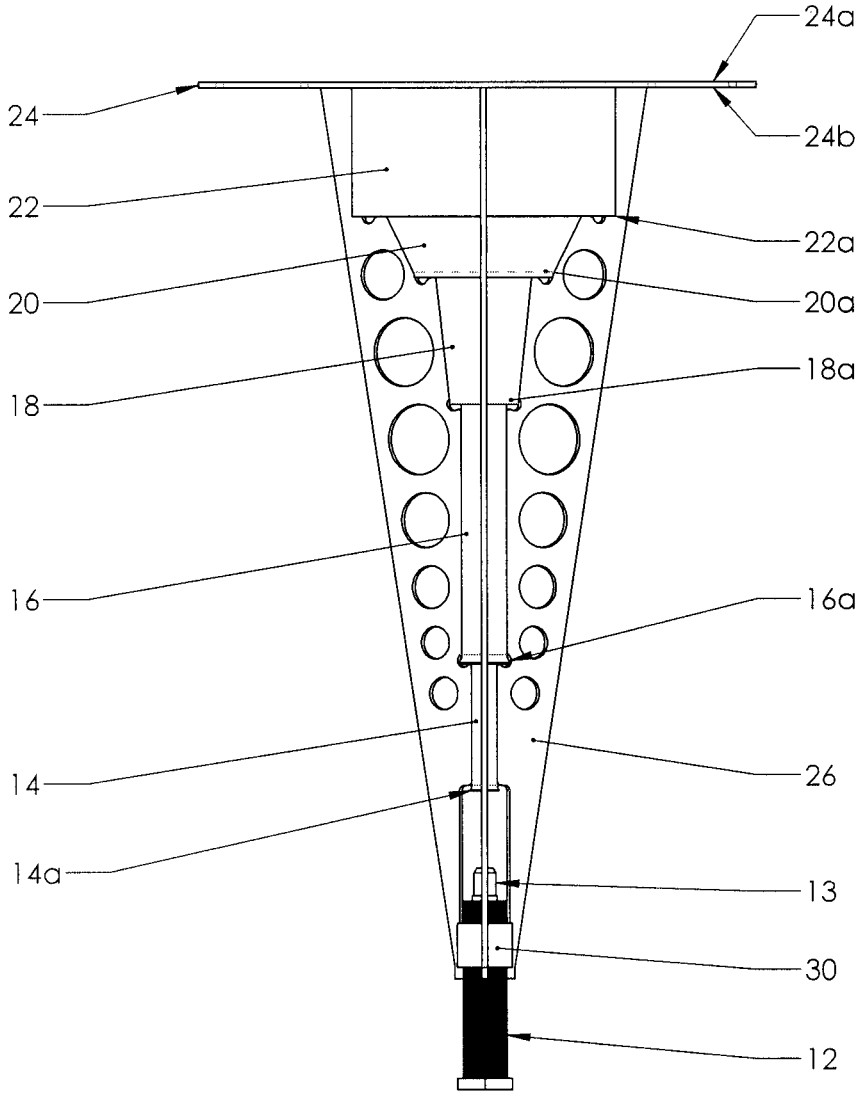
FIG. 2 is a side view of the fuel-air mixing system of FIG. 1.

FIGS. 1 and 2 illustrate the fuel-air mixing system coupled with the fuel injector (disassembled from the combustor) in an exemplary embodiment of the present invention. As depicted in FIGS. 1 and 2, fuel-air mixing system 10 comprises first fuel intake tube/concentrator duct 14 having an inlet end 14*a* and an outlet end 14*b* (not shown), in communication with the second fuel intake tube/concentrator duct 16 having inlet end 16*a* and outlet end 16*b* (not shown), which in turn is in communication with the first diffuser duct 18. The inlet end 14*a* of the first tube is configured to receive the fuel injected from the injector 12, and outlet end 14*b* is positioned within second tube 16 through the inlet end 16*a*. Similarly, the outlet end 16*b* (not shown) of the second tube is positioned within the first diffuser via its inlet end 18*a*. The outlet end 18*b* (not shown) of the first diffuser duct is positioned within the second diffuser duct 20 via its inlet end 20*a*, and the outlet end 20*b* (not shown) of the second diffuser duct is positioned within the third diffuser duct 22 via its inlet end 22*a*. The outlet end 22*b* (not shown) of the third diffuser duct 22 is attached/coupled with the flanged ring 24.

In this example, the injector 12 (having nozzle 13), first and second intake tubes 14 and 16, first, second and third diffuser ducts 18, 20 and 22 are held in their positions in an inline orientation by three longitudinally oriented brackets 26, extending from a ring 30 placed around the body of the injector 12 and joining the bottom potion 24*b* of the flanged ring 24.

Figure 4:
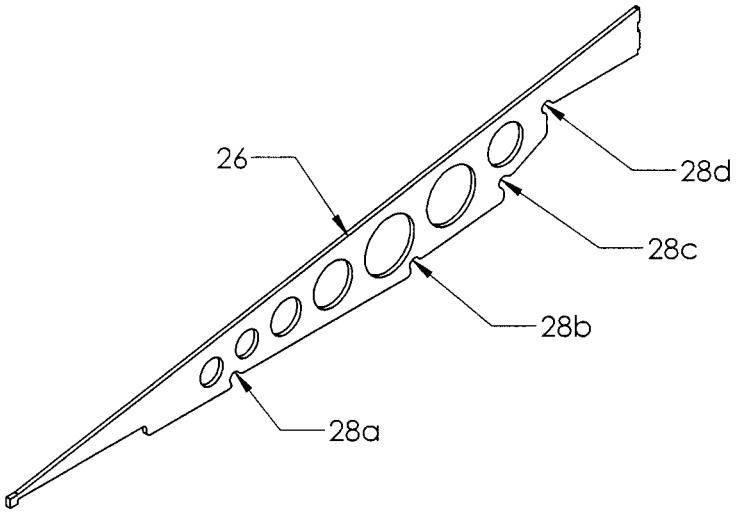
FIG. 4 is a perspective view of a coupling member for the fuel-air mixing system in accordance with an embodiment of the present invention.

As shown in FIG. 4, each of the brackets 26 has notches 28*a*-28*d* configured to support/hold the inlet ends of the fuel intake tubes and the diffuser ducts.

The notches (28*a*-28*d*) of each of the brackets 26 are configured to hold the inlet of the first tube in line with the fuel injector, the inlet of the second tube in line with the outlet of the first tube, the inlet of the first diffuser duct with the outlet of the second tube, the inlet end of the second diffuser duct in line with the outlet of the first diffuser duct and the inlet end of the third diffuser duct in line with the outlet of the second diffuser duct, respectively. The upper end of each of the brackets 26 is attached to the bottom surface 24*b* of the flanged ring 24.

The penetration depth of the first tube into the second tube and the penetration depth of the second tube into the first diffuser duct, the penetration depth of the second diffuser into the second diffuser duct, and the penetration depth of the second diffuser duct into the third diffuser duct are not depicted in FIGS. 1 and 2.

Figure 3A:
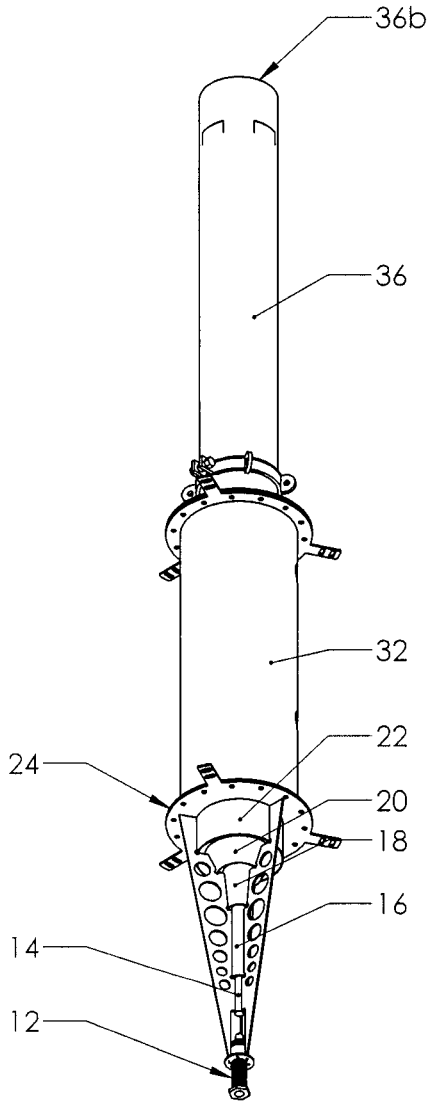
FIG. 3*a* is a perspective view of the incinerating system in accordance with an embodiment of the present invention.
Figure 3B:
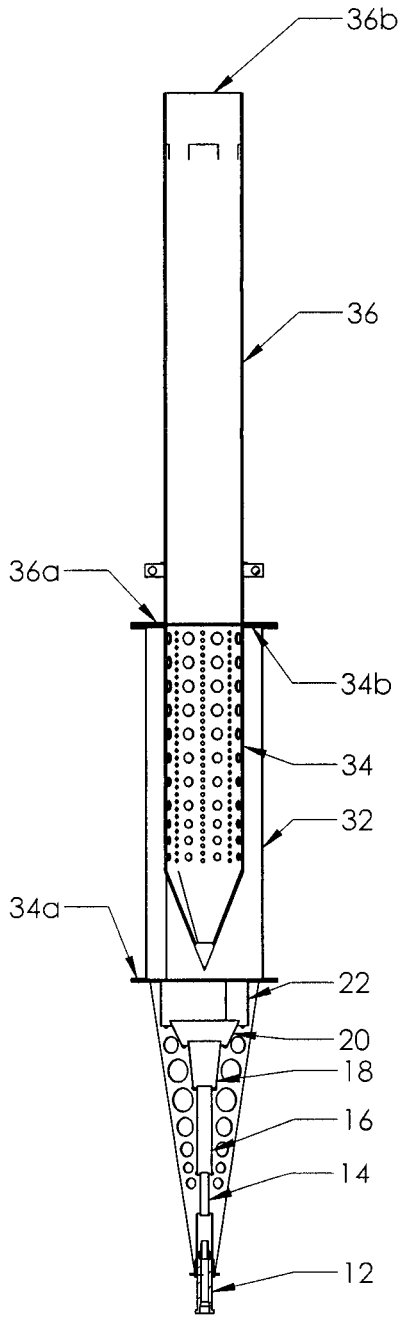
FIG. 3*b* is a schematic cross-sectional view of the incinerating system of FIG. 3*a*.

Turning to FIGS. 3*a* and 3*b* depicting an example of the incinerator system of the present invention, wherein the fuel-air mixing system is connected with the combustor 32 having a cylindrical body defining the combustor chamber 34 having inlet end 34*a* and an outlet portion having a second end 34*b*.

Figure 5:
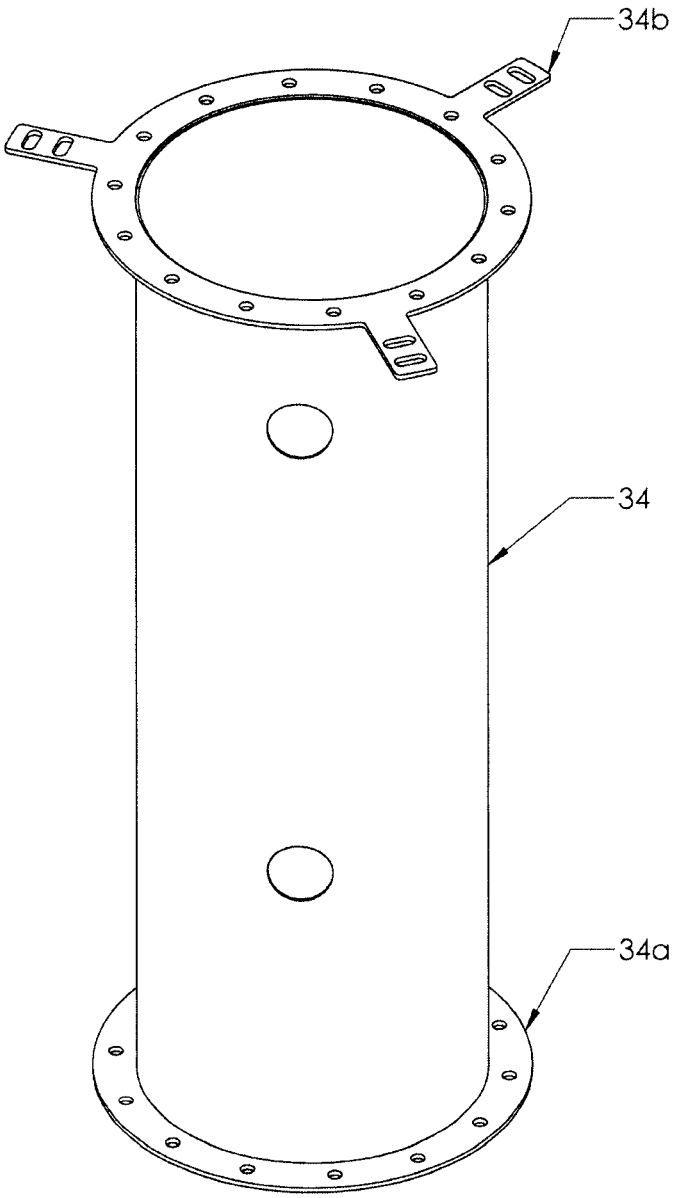
FIG. 5 is a perspective view of the combustion chamber in accordance with an embodiment of the present invention.

As shown in FIG. 5, the ends 34*a* and 34*b* of the combustor in this example are flanged, wherein flange 34*a* is configured to connect with the flanged ring 24 of the fuel-air system.

Figure 6:
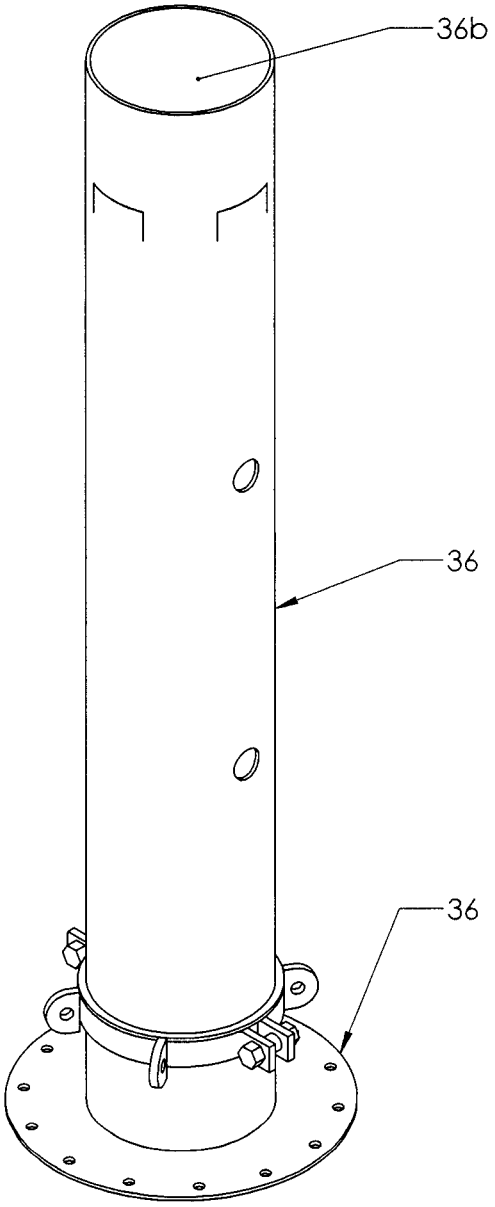
FIG. 6 is a perspective view of the exhaust pipe in accordance with an embodiment of the present invention.

In this example, the combustor also has an exhaust pipe 36 having a first flanged end 36*a* and a second end 36*b* (FIG. 6). The end 36*a* of the exhaust pipe is connected with the flanged end 34*b* of the combustor. The exhaust pipe extends away from the combustor chamber and the end 36*b* defines an outlet of the exhaust tube.

As depicted in FIGS. 3*a* and 3*b*, in this example, the combustor has an additional combusting canister 38 extending into the combustor chamber from the end 34*b* thereof.

Figure 7:
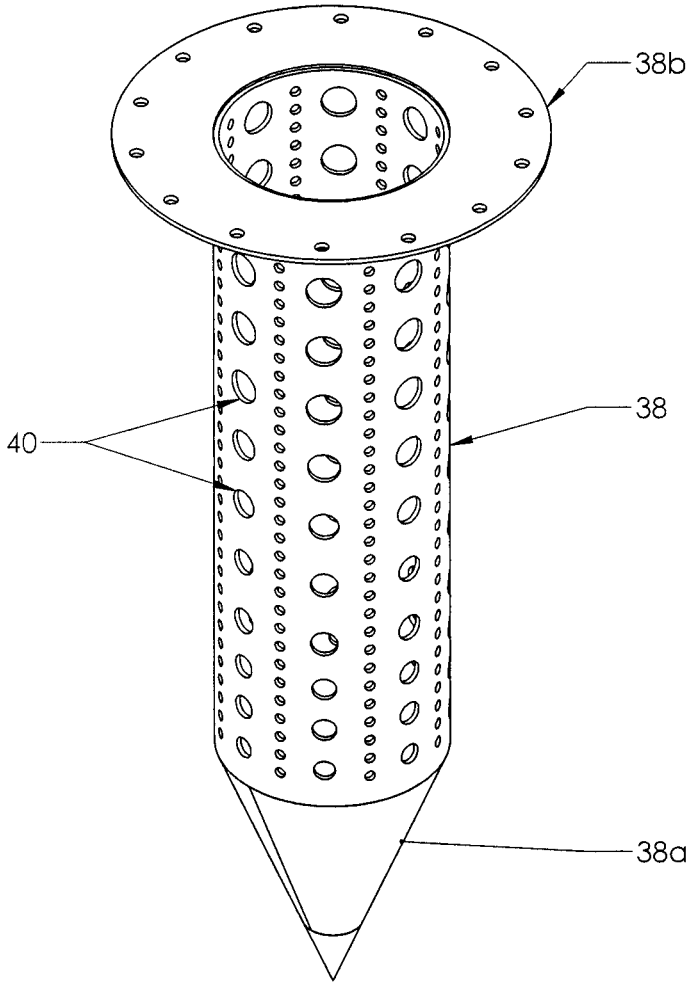
FIG. 7 is a perspective view of the combusting canister in accordance with an embodiment of the present invention.

As shown in FIG. 7, the combustion canister has an upper flanged end 38*b* and a lower conical end 38*a*, wherein the flanged end 38*b* is configured to be held within the flanged connection between the upper end 34*b* of the combustor and the first end 36*a* of the exhaust pipe. The combustor canister also has plurality of perforations 40 on its walls.

Figure 8A:
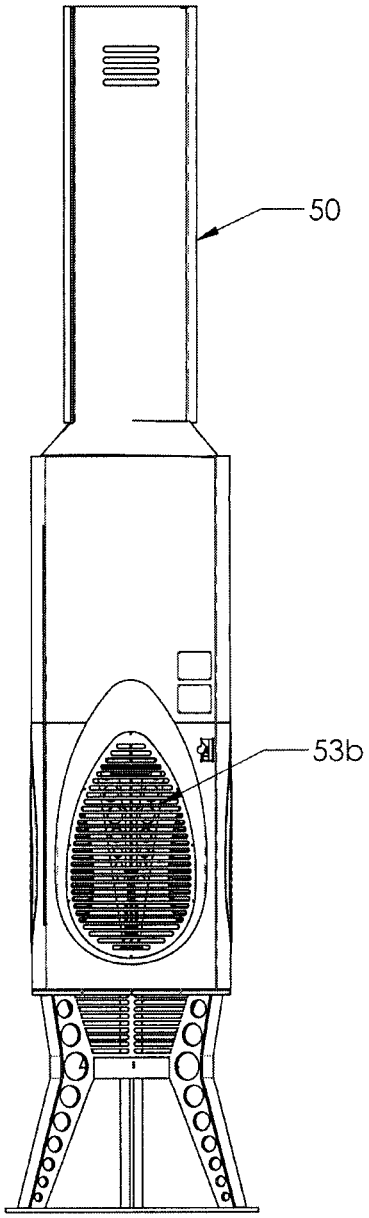
FIG. 8*a* is a perspective view of the protective shroud in accordance with an embodiment of the present invention.
Figure 8B:
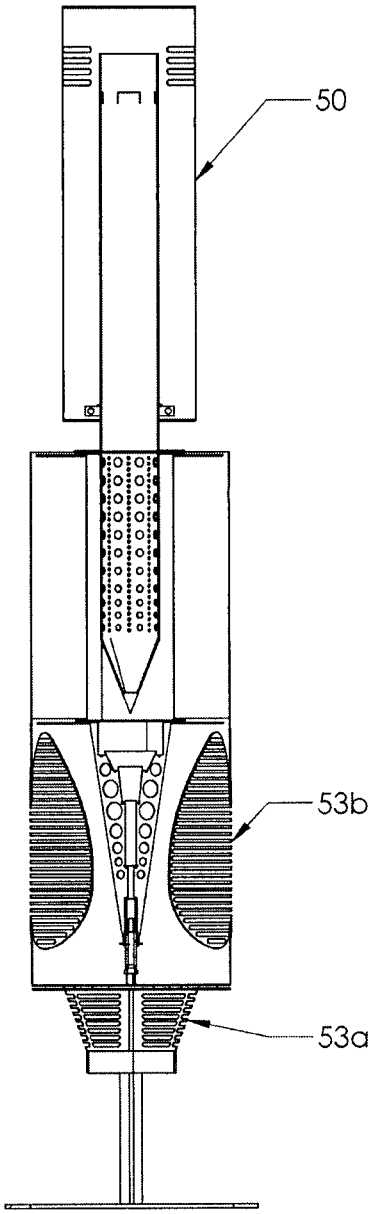
FIG. 8*b* is a schematic cross-sectional view of the protective shroud of FIG. 8*a*.
Figure 8C:
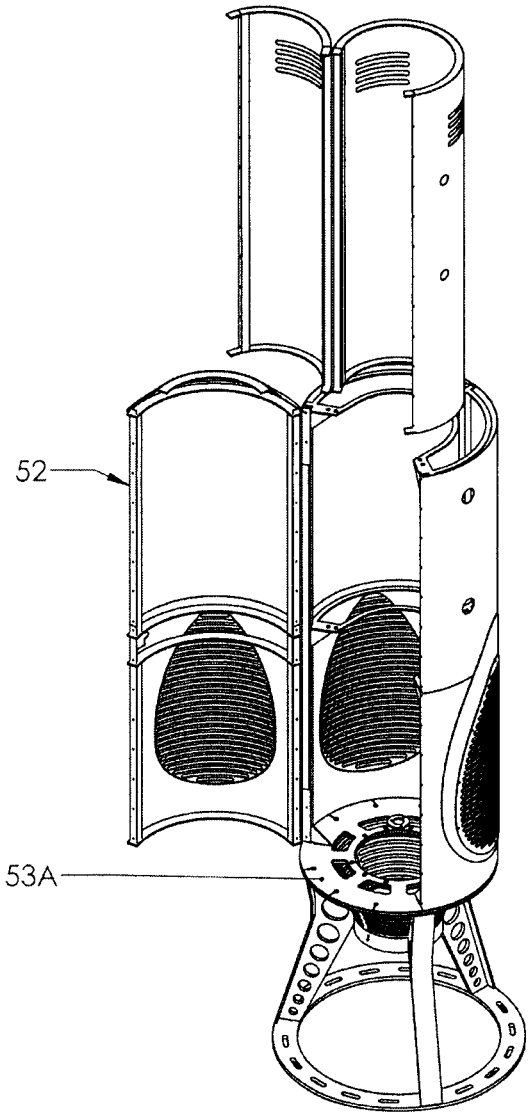
FIG. 8*c* is a perspective view of the protective shroud in accordance with an embodiment of the present invention with a door.

FIGS. 8A to 8C illustrate a protective shroud 50 for the incinerator system depicted in FIGS. 3*a* and 3*b*. The protective shroud has perforations/slots 53*a* on bottom wall thereof, and perforations/slots 53*b* on the lower side walls. In this example, the protective shroud has a hinged door or cover 52, to provide ease of access to the incinerator system enclosed therein.

Figure 9A:
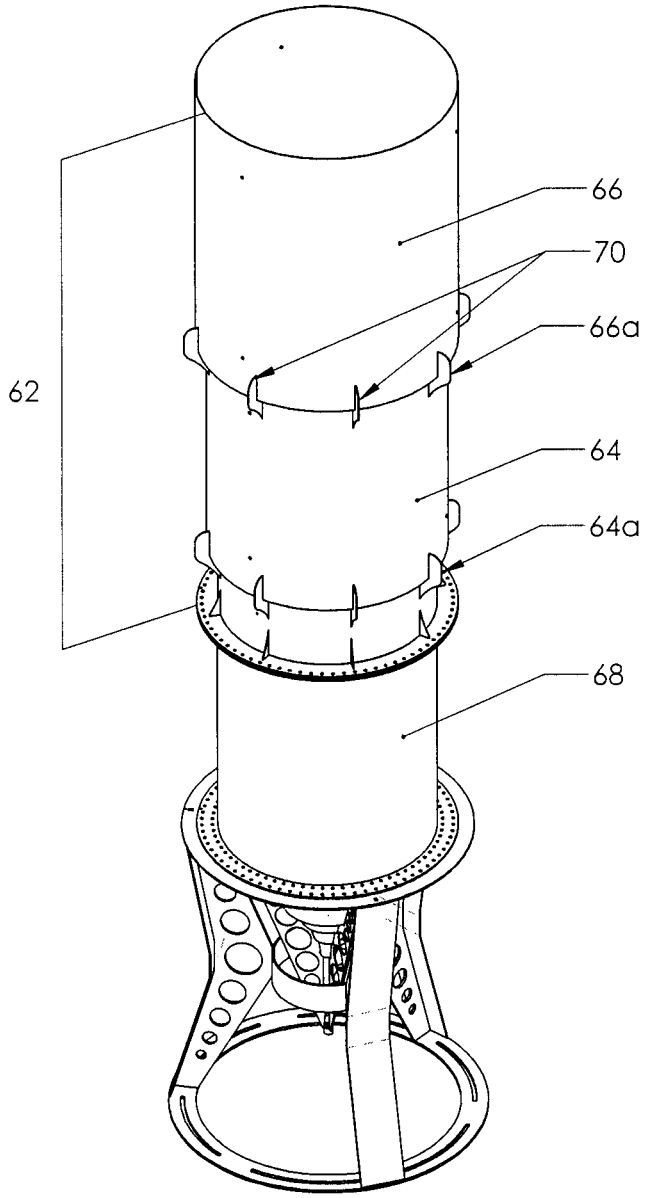
FIG. 9*a* is a perspective view of the incinerating system in accordance with another embodiment of the present invention.
Figure 9B:
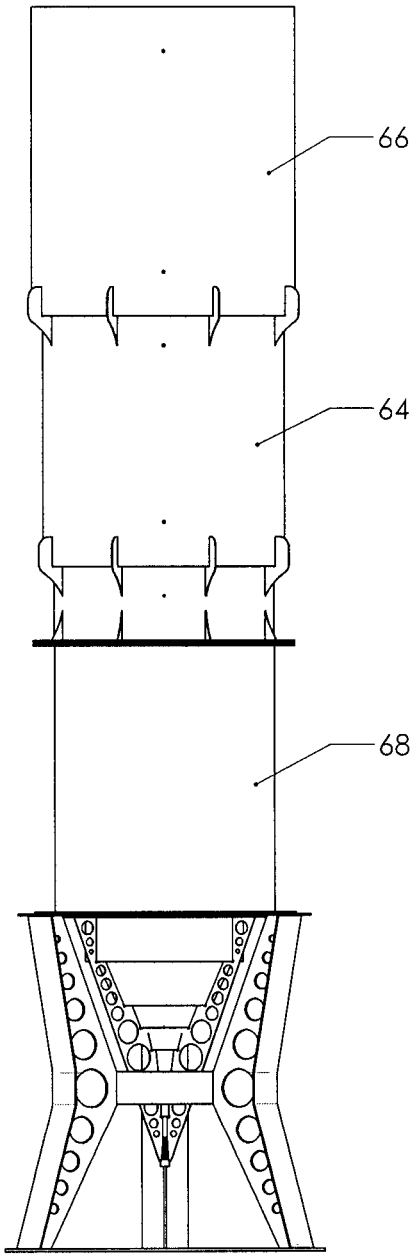
FIG. 9*b* is a side view of the incinerating system of FIG. 9*a*.
Figure 9C:
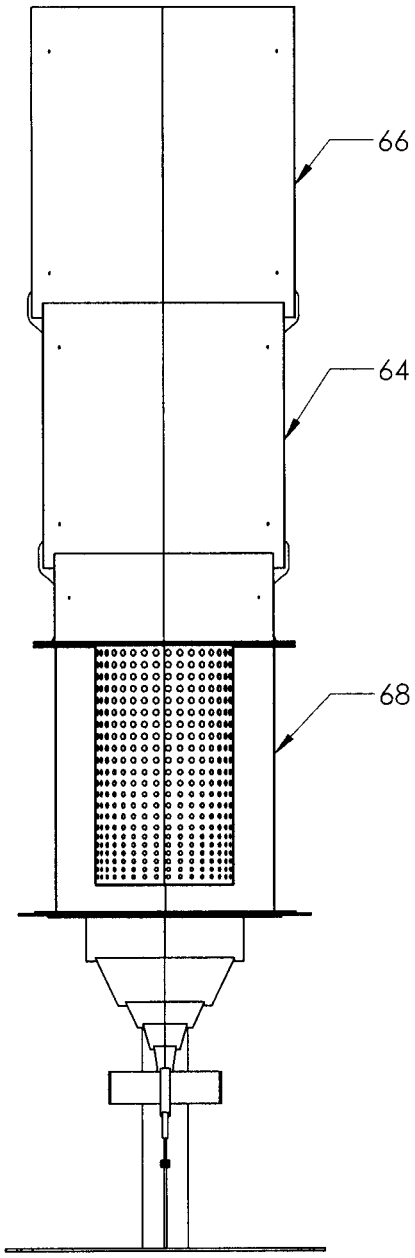
FIG. 9*c* is a schematic cross-sectional view of the incinerating system of FIG. 9*a*.

FIGS. 9A to 9C illustrate another example of the incinerator system of the present invention, wherein, the outlet portion of combustor 62 comprises two stacked cylindrical segments 64 and 66. The first cylindrical segment is positioned above the combustion chamber 68 and has a diameter that is greater than the combustion chamber, thereby providing a first air intake location 64*a* between the combustor and the first cylindrical segment 62. In addition, the second cylindrical segment has a diameter greater than the first cylindrical segment, thereby providing a second air intake location 66*a* between the first cylindrical segment and the second cylindrical segment. Due to the different diameters of the cylindrical segments, support slots 70 are provided in a lower component, which provides for the support of a larger diameter component above.

Figure 10A:
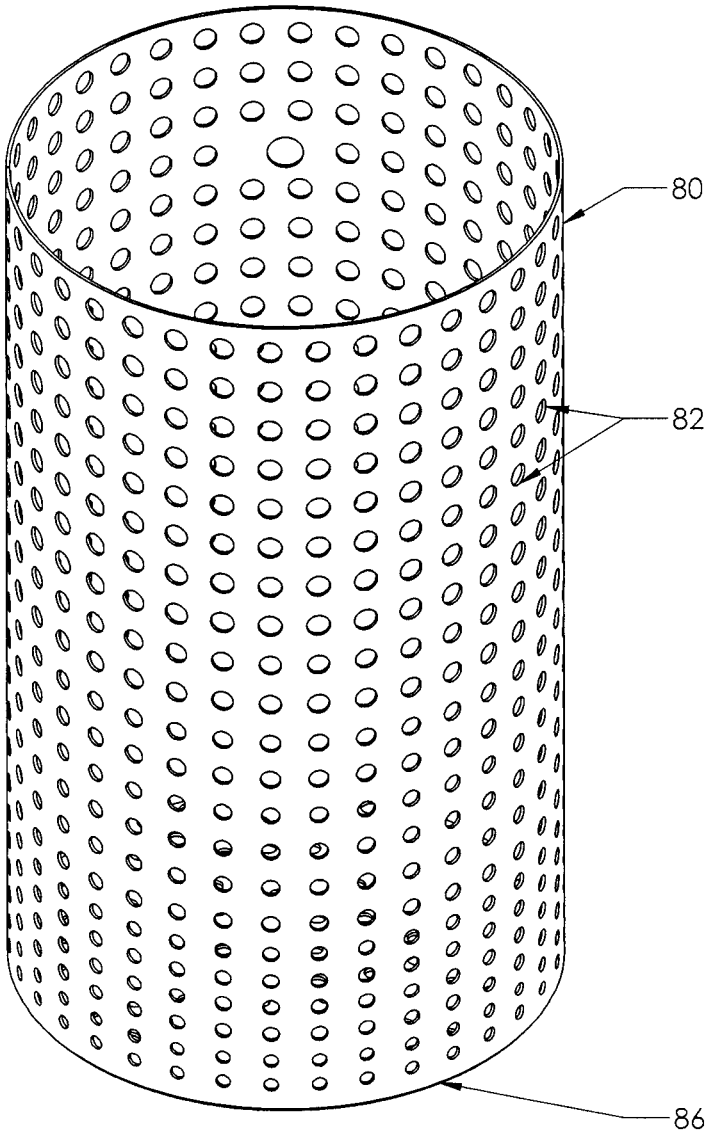
FIG. 10*a* is a perspective view of the combusting canister in accordance with another embodiment of the present invention.
Figure 10B:
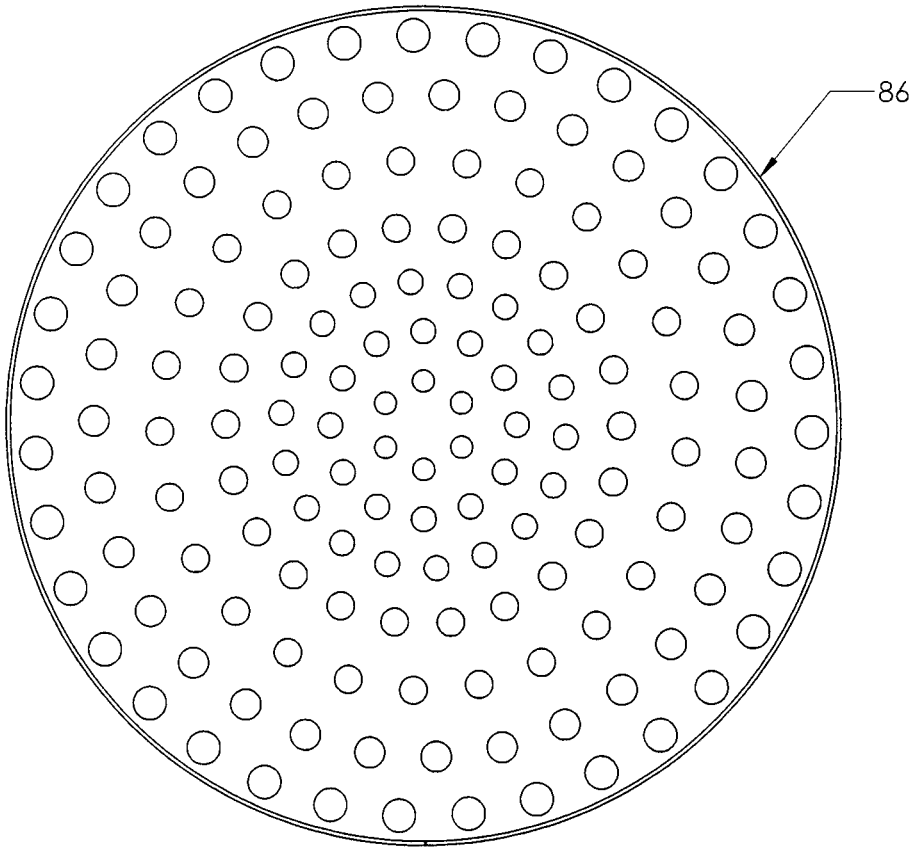
FIG. 10*b* is a bottom view of FIG. 10*a*.

FIGS. 10A and 10B illustrate another example of combusting canister, which is configured as a closed-bottom cylinder 80 including a plurality of holes 82 therein, on the side wall 84 and the bottom 86. In this example, the holes 86 in the bottom increase in diameter as radially towards the out edge of the bottom.

Figure 11:
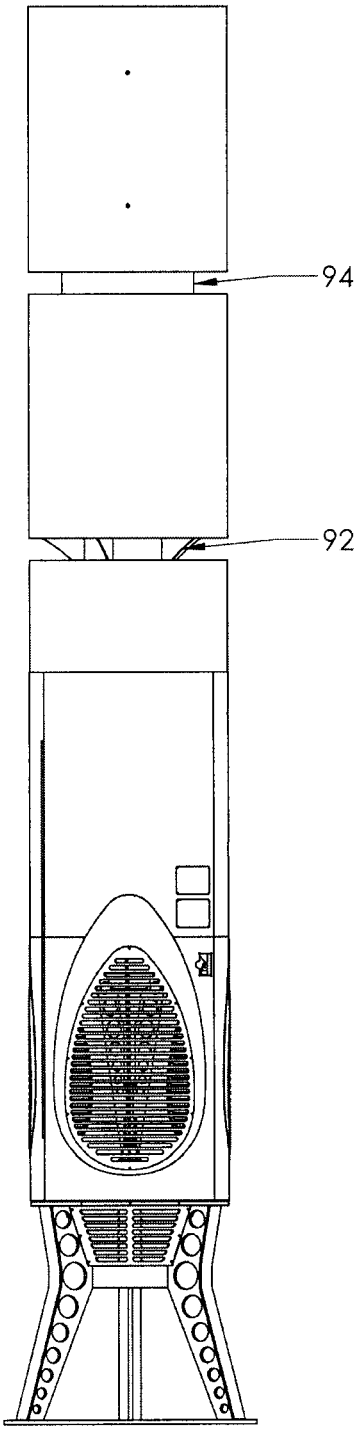
FIG. 11 is a perspective view of the protective shroud in accordance with another embodiment of the present invention.

FIG. 11 depicts a protective shroud 90 configured to enclose the incinerator system including a segmented exhaust pipe as illustrated in FIGS. 9A to 9C. In this example, the protective shroud is configured similar to the shroud as discussed above with respect to FIGS. 8A to 8C, with modifications for enhancing the functionality of the segmented exhaust pipe. In this example, the upper portion of the shroud includes a first air entry 92 and a second air entry 94, wherein these air entries provide opening for external air to enter into the first air intake and the second air intake of the segmented exhaust pipe. By providing these opening within the shroud, cooler external air can be provided to the air intakes, which can improve the secondary and tertiary combustion of residual fuel in the segmented exhaust pipe.

Figure 12:
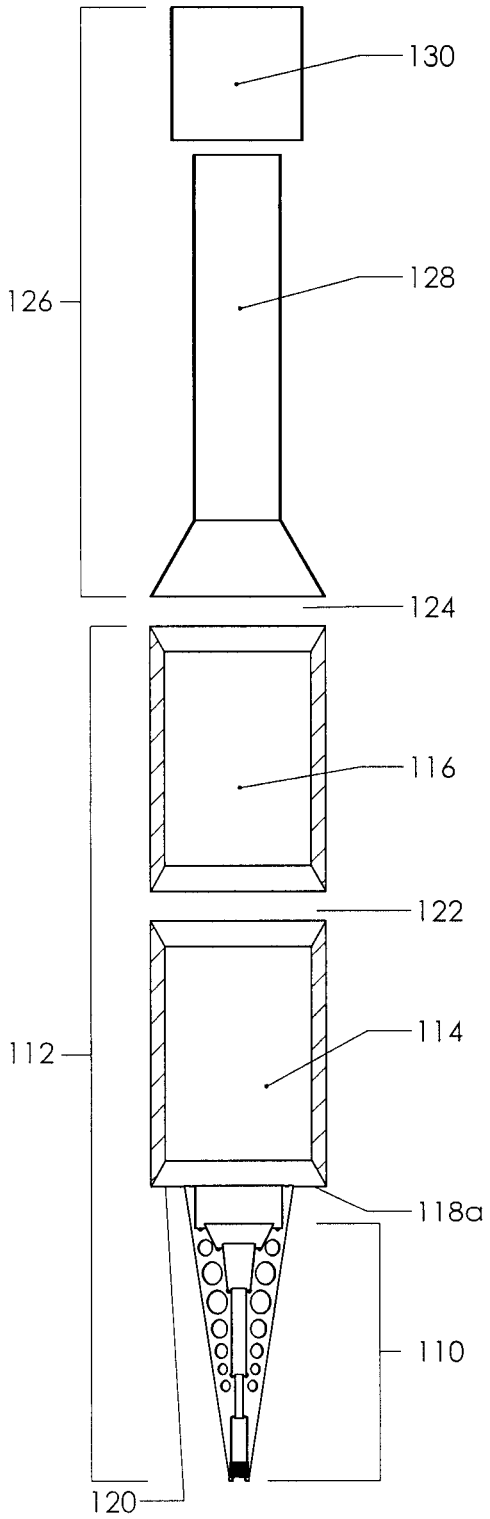
FIG. 12 is a schematic cross-sectional view of the incinerating system in accordance with an embodiment of the present invention.

FIG. 12 depicts an example of the incinerator system of the present invention, wherein the fuel-air mixing system 110 is connected with combustor 112 defining the segmented combustor chambers 114 (primary chamber) and 116 (after burner). The combustor has inlet end 118*a* and a second end 118*b* communicating with the exhaust system 126 having segmented portions 128 and 130. The primary chamber is in communication with the fuel-air mixing system 110 via the inlet end 118*a* and the primary ignition source 120. In some cases secondary and tertiary ignition sources 122 and 124 may also be provided. For example, the first secondary ignition source can provided at the junction of the primary combustor and the first after burner, and so on. A tertiary ignition source can be provided at the junction of the last afterburner and the entry of exhaust system.

It will be readily understood that all components discussed herein can be constructed of any suitable materials. Further, all components discussed herein can be manufactured by any suitable process that will be readily appreciated by the skilled person.

In the tests, combustors were made of steel. However, other materials can be used as well. One consideration is that the materials have sufficient resistance to heat, especially for the combustion chamber and exhaust pipe.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

The scope of the claims should not be limited by the preferred embodiments set forth in the description, but should be given the broadest interpretation consistent with the description as a whole.

We claim:

1. A fuel incinerating system comprising:

a fuel injector configured to inject fuel at a predetermined velocity;

a multi-stage fuel-air mixing device having an inlet end and an outlet end, the multi-stage fuel-air mixing device being in fluidic communication at the inlet end with the fuel injector to receive fuel injected from the fuel injector to be mixed with entrained air to form a fuel-air mixture, the multi-stage fuel-air mixing device comprising a plurality of fuel intake tubes stacked vertically, each intake tube having an inlet and an outlet, wherein the cross sectional area of the inlet of each intake tube is greater than the cross sectional of the outlet of a preceding intake tube, thereby providing an annular gap between two adjacent intake tubes for entraining additional air when the fuel-air mixture is passed from one intake tube into the adjacent intake tube;

a combustor extending vertically from the multi-stage fuel-air mixing device, the combustor having an inlet portion in fluidic communication with the outlet end of the multi-stage fuel-air mixing device, and an outlet portion to exhaust products of fuel combustion, said combustor defining a combustor chamber between the inlet and the outlet portions; said combustor further in communication with a primary ignition source;

wherein the combustor is configured to impede flow of the fuel-air mixture through the combustion chamber to achieve a desired retention time of the fuel-air mixture within the combustion chamber;

wherein the combustor comprises two or more segmented combustion chambers each having an inlet portion and an outlet portion, wherein the first segmented chamber communicates with the fuel-air mixing device and a primary ignition source to define a primary combustion chamber and subsequent segments define afterburners and are in communication with the outlet portion.

2. The incinerating system according to claim 1, wherein one or more of the afterburners are provided with a secondary ignition source and/or a tertiary ignition source.

3. The incinerating system according to claim 1, wherein cross sectional area of the inlet of at least one of the segmented combustion chamber is greater than the cross sectional area of the outlet of a preceding segmented combustion chamber.

4. The incinerating system according to claim 1, wherein the outlet portion of the combustor is comprised of two or more stacked segmented portions, each having an inlet and outlet.

5. The incinerating system according to claim 4, wherein the cross sectional area of the inlet of at least one of the segmented outlet potions is greater than the cross sectional area of a preceding segmented outlet portion.

6. The incinerating system according to claim 1, wherein the combustion chamber has a canister having a plurality of holes therein.

7. The incinerating system according to claim 6, wherein a first hole has a first diameter and is positioned closer to the fuel mixing device than a second hole having a second diameter, wherein the first diameter is less than the second diameter.

8. The incinerating system according to claim 1, further comprising an exhaust pipe in fluidic communication with the outlet portion of the combustor.

9. The incinerating system according to claim 8, wherein the exhaust pipe has an annular ring at the outlet thereof, the annular ring projecting into the interior of the exhaust pipe.

10. The incinerating system according to claim 8, wherein the exhaust pipe includes two or more stacked cylindrical segments, each having an inlet and an outlet.

11. The incinerating system according to claim 10, wherein a first segment of the stacked cylindrical segments has a first cross sectional area and a second segment of the stacked cylindrical segments has a second cross sectional area, the first segment is closer to the combustion chamber than the second segment and wherein the first cross sectional area is less than the second cross sectional area.

12. The incinerating system according to claim 11, wherein the first cross sectional area and the second cross sectional area are selected to provide an annular gap between the first segment and the second segment for air entrainment into the stacked cylindrical segments.

13. The incinerating system according to claim 12, wherein the first segment is connected to the combustor and has a cross sectional area smaller than the cross sectional area of the outlet portion of the combustor.

14. The incinerating system according to claim 12, wherein the first segment has a cross sectional area greater than the cross sectional area of the outlet portion of the combustor, thereby providing an additional air intake location between the combustor and the first cylindrical segment.

15. The incinerating system according to claim 14, wherein at least one of the stacked cylindrical elements has an annular ring at the outlet thereof, the annular ring projecting into the interior of the at least one of the stacked cylindrical elements.

16. The incinerating system according to claim 15, wherein the annular ring is formed from a plurality of dimples or formed as a protrusion.

17. The incinerating system according to claim 1 further comprising a protective shroud surrounding the combustion chamber, wherein the protective shroud includes one or more air entries.

18. The incinerating system according to claim 17, wherein the exhaust pipe includes a first segment and a second segment in a stacked configuration wherein the first segment has a cross sectional area smaller than a cross sectional area of the second segment enabling air entrainment into the second segment, and wherein the one or more air entries of the shroud align with a transition zone between the first segment and the second segment, and/or wherein the one or more air entries of the shroud are offset with a transition zone between the first segment and the second segment.

19. The incinerating system according to claim 2, wherein the secondary ignition source and/or tertiary ignition source is provided within the segmented combustion chambers.

20. The incinerating system according to claim 2, wherein the primary, secondary and/or tertiary ignition sources are provided proximate to the air intake or at a location that can be removed from the air intake location, while being within the path of the air entering the incinerator system at the air intake.

21. A method of enhancing incineration of a fuel, the method comprising:

providing a vertically stacked multi-stage fuel-air mixing device in fluidic communication with a source of air at one end and a combustor at the other end, the multi-stage fuel-air mixing device including a plurality of fuel intake tubes stacked vertically, each intake tube having an inlet and an outlet, wherein the cross sectional area of the inlet of each tube is greater than the cross sectional area of the outlet of a preceding intake tube to provide an annular gap between two adjacent tubes for entraining additional air;

injecting a fuel into the multi-stage fuel-air mixing device to achieve momentum/velocity for the mixed air and fuel to flow into the combustor and entraining additional air when air-fuel mixture being ejected into the adjacent fuel intake tube, impeding the flow of the mixed fuel and air through the combustor to achieve a desired retention time of the mixed fuel and air within a combustion chamber, thereby creating a fuel-air mixture having fuel to air ratio sufficient for more than 90% combustion of the fuel;

wherein the combustor comprises two or more segmented combustion chambers each having an inlet portion and an outlet portion, wherein the first segmented chamber communicates with the fuel-air mixing device and a primary ignition source to define a primary combustion chamber and subsequent segments define afterburners and are in communication with the outlet portion.

* * * * *